US005083822A

United States Patent [19]

Mangin et al.

[11] Patent Number: 5,083,822

[45] Date of Patent: Jan. 28, 1992

[54] MEDIAN HOUSING FOR MULTIPOINT ANTIPANIC LOCK AND ANTIPANIC LOCK FITTED WITH SUCH A HOUSING

[75] Inventors: Robert Mangin, St. Benoit-sur-Seine; Pascal Magnain, Troyes; Jean-Pierre Muller, Cormost; Francois Weil, Romilly-sur-Seine, all of France

[73] Assignee: Vachette, Paris, France

[21] Appl. No.: 556,543

[22] Filed: Jul. 24, 1990

[30] Foreign Application Priority Data

Jul. 24, 1991 [FR] France ..... 89 09941

[51] Int. Cl.[5] ..... E05C 9/04

[52] U.S. Cl. ..... 292/21; 292/36; 292/92; 292/244

[58] Field of Search ..... 292/DIG. 62, 34, 35, 292/21, 92, 40, 244, DIG. 65, 245, 36; 70/92

[56] References Cited

U.S. PATENT DOCUMENTS

| | | | |
|---|---|---|---|
| 912,379 | 2/1909 | Jackson | 292/DIG. 60 |
| 1,345,041 | 12/1917 | Voight | 292/21 |
| 1,941,225 | 12/1931 | Radke et al. | 292/37 |
| 2,932,536 | 4/1960 | Pyknen | 70/92 X |
| 3,097,007 | 7/1963 | Eichacker et al. | 292/332 X |
| 3,333,878 | 8/1967 | Pelcin | 292/150 X |
| 3,993,335 | 11/1976 | Schmidt | 292/336.3 X |
| 4,088,353 | 5/1978 | Meyer | 292/40 X |
| 4,295,673 | 10/1981 | Miller | 292/21 |
| 4,362,328 | 12/1982 | Tacheny et al. | 292/36 |
| 4,387,917 | 6/1983 | Cocker | 292/40 |
| 4,470,277 | 9/1984 | Uyeda | 292/36 X |
| 4,982,986 | 1/1991 | Gressett, Jr. et al. | 292/336.3 |

*Primary Examiner*—Gary L. Smith
*Assistant Examiner*—Darnell M. Boucher
*Attorney, Agent, or Firm*—Cushman, Darby & Cushman

[57] ABSTRACT

The housing comprises an actuating lever (8) articulated about a transversal spindle (13), and a mechanism (16), controlled by the lever, capable of driving, in opposite direction, two rods (17, 18); each rod is provided, at its end farthest away from the housing, with a bolt, in order to bring about a locking at an upper point and a lower point, respectively. The actuating lever (8) comprises a unilateral thrust organ (19) capable of co-operating with one or two complementary abutments (21, 22) provided for on a driving organ (23) of the mechanism (16), whereby the lever (8) may be tilted from one position into another, to co-operate with the appropriate complementary abutment (21, 22), in order to selectively allow the fitting onto a "right-hand" or "left-hand" door.

12 Claims, 3 Drawing Sheets

MEDIAN HOUSING FOR MULTIPOINT ANTIPANIC LOCK AND ANTIPANIC LOCK FITTED WITH SUCH A HOUSING

The invention relates to a median housing for a multipoint antipanic lock, of the type of those which comprise an actuating lever articulated about a transversal spindle, and a mechanism, controlled by the lever, capable of driving, in opposite direction, two rods located on both sides of the housing and intended to be in vertical position when the lock is fitted onto a door, each rod being provided, at its end farthest away from the housing, with a bolt, in order to bring about a locking at an upper point and a lower point, respectively.

It is known that a door may be of the "right-hand" type or of the "left-hand" type, according to whether the hinges are located at one side or the other of the door.

The median housings for multipoint antipanic locks are generally of two types corresponding to each type of door. This results in it being convenient to keep in stock two types of housings, which complicates the work. The fitter of a lock may come up with a housing which is not suited for the door onto which it is to be fitted, which generates a loss of time. Furthermore, this existence of two types of housings, corresponding to both types of doors, is a source of errors, viz. at the time of ordering and delivering the parts.

The object of the invention is, above all, to provide a median housing for a multipoint antipanic lock of the type defined above which does no longer have, or has to a lesser extent, the inconveniences evoked above. It is desirable, moreover, for such a median housing to be of a relatively economical construction and to be capable of being adapted, by means of a sample and quick operation, both for a "right-hand" door and a "left-hand" door.

According to the invention, a multipoint median housing for an antipanic lock, of the type defined above, is characterized in that the actuating lever comprises a unilateral thrust organ capable of co-operating with one of two complementary angularly spaced thrusts provided for on a driving organ of the mechanism, whereby the lever may be tilted from one position into another, to co-operate with the appropriate complementary thrust, in order to indiscriminately allow the fitting onto a "right-hand" or a "left-hand" door, while the mechanism capable of driving the rods is symmetrically arranged, so that the housing be fully reversible.

The unilateral thrust organ of the lever may consist of a pawl, while said driving organ consists of a plate substantially orthogonal to the spindle of the lever, the complementary thrust organs being formed by the ends of an opening having the shape of an arc of a circle, centered about the rotation axis of the lever, and provided for in said plate. This plate may have a substantially rectangular shape and be freely pivoting about the spindle of the lever, towards one of its apices, said plate co-operating, at the opposite apex, with a rod-actuating device, while said opening having the shape of an arc of a circle has its ends located in the proximity of the apices of the other diagonal.

Advantageously, the driving organ is located in the mean longitudinal plane of the housing and is provided, on the side opposite to the articulation axis of the lever, with pushing means projecting on both sides of the driving organ, to co-operate, in the direction of rotation of the driver, with one of two identical components mounted in opposite direction to actuate the rods.

Preferably, the above-mentioned identical components are slidingly mounted in the housing and comprise a part having substantially the same width as the housing, to which part is connected one end of a rod, this part comprising an extension, towards the other component, having a width slightly smaller than half of the width of the housing, this extension being adjacent to a face of the housing, the driving organ being located between both extensions.

A rotating component is mounted inside the housing, so that it pivots about an axis orthogonal to the bottom of the housing against which slide the above-mentioned rod-actuating components, this rotating component being capable of transferring, while reversing same, the motion from one rod to another.

According to a first possibility, the rotating component, having a substantially rectangular shape, comprises, on two opposite sides, a cut, open towards outside, capable of co-operating with a pin provided for under each sliding component it is integral with.

Preferably, each extension comprises, at its end farthest away from the associated rod, a shoulder capable of being driven by the pushing means of the lever formed by a pin.

Advantageously, said shoulder comprises a transversal wing onto which comes to be fastened one end of a pull-off spring the other end of which is fastened onto a pin integral with said housing.

Each extension preferably comprises an elongated opening through which passes the pin.

According to another possibility, the rotating component is connected, at each of its ends, by means of a joint, viz. formed by a pawl, with the extension of one of the sliding components, said components being mounted into the housing with a possibility of oscillating.

Advantageously, the housing comprises one single torsional spring, centered about the rotation axis of the rotating component, capable of pulling off this component into the neutral position, viz. by actuating onto an articulation pawl between the rotating component and the extension of a sliding component.

The pushing means may comprise two angularly spaced feet located on both sides of the median plane of the driving organ.

The invention also relates to a multipoint antipanic lock comprising a median housing such as defined above.

The invention consists, besides the arrangements set forth above, in a number of further arrangements which will be more explicitly explained below with respect to embodiments described with reference to the attached drawings, but which are in no way exhaustive.

FIG. 1 of these drawings is a schematic view of a door fitted with a multipoint antipanic lock.

Figure 9:
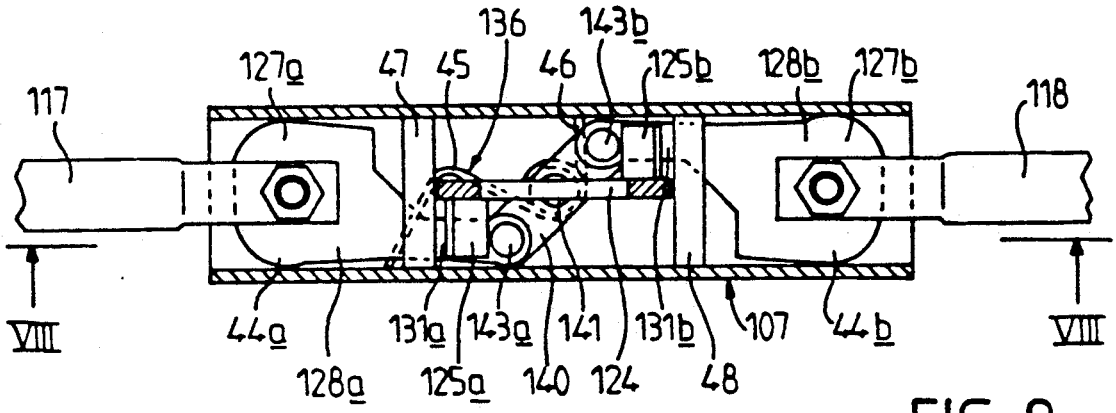
FIG. 9 is a cross-sectional view, according to line IX—IX of FIG. 8, the actuating lever of the lock being in a neutral position.
Figure 10:
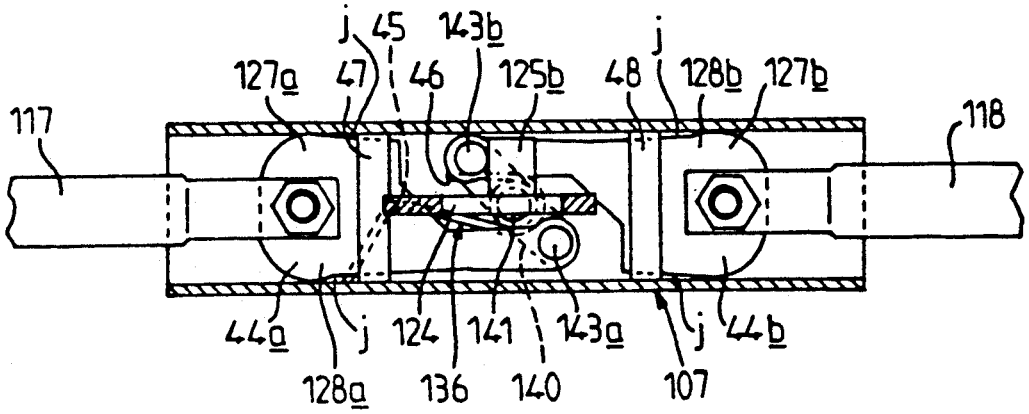

FIG. 10, finally, is a cross-sectional view similar to FIG. 9, the components being shown in the position in which they are when the actuating lever has been actuated.

Figure 1:
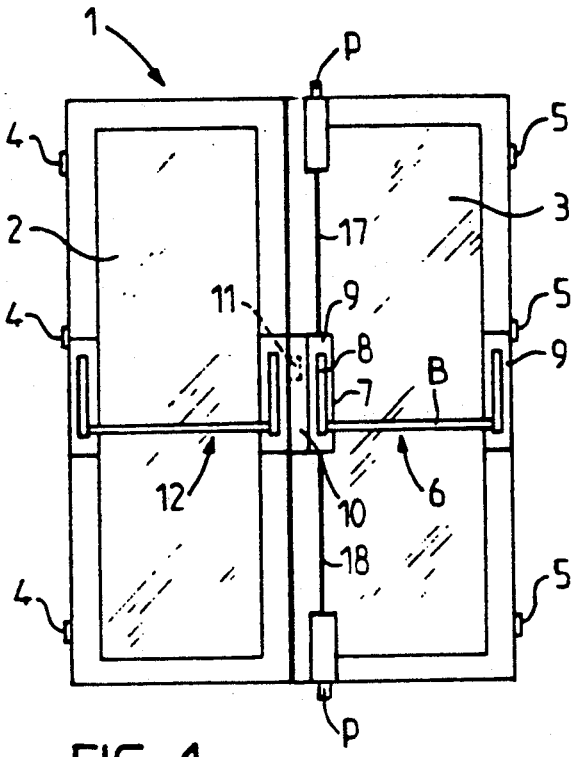
Figure 4:
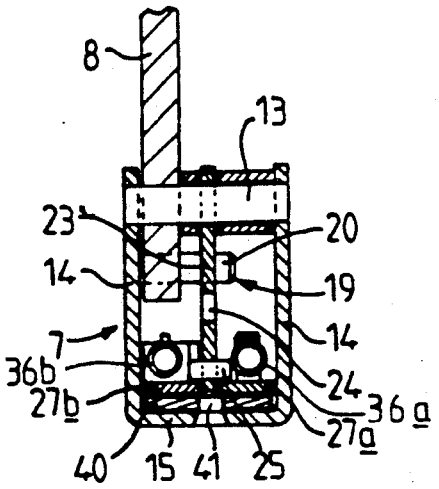
FIG. 4 is a cross-sectional view according to line IV—IV, FIG. 3.

Referring to FIG. 1, one can see a door 1 with two leaves 2, 3 fitted, on their vertical external edges, with hinges 4, 5, respectively.

Leaf 3, located on the right-hand side of FIG. 1, is fitted with a multipoint antipanic lock 6 comprising a median housing 7. Lock 6 may be controlled, from inside the building, by acting onto a horizontal rod B supported, at its end located on the side of housing 7, by a lever 8 articulated in this housing and, at its other end, by a lever articulated in another housing 9 fixed onto the door.

The median housing 7 is mounted adjacent to a median keeper 10 fixed onto the edge of leaf 3 adjacent to leaf 2. This keeper 10 is intended for receiving a transversal bolt 11 of another anti-panic lock 12 fitted onto leaf 2.

Figure 2:
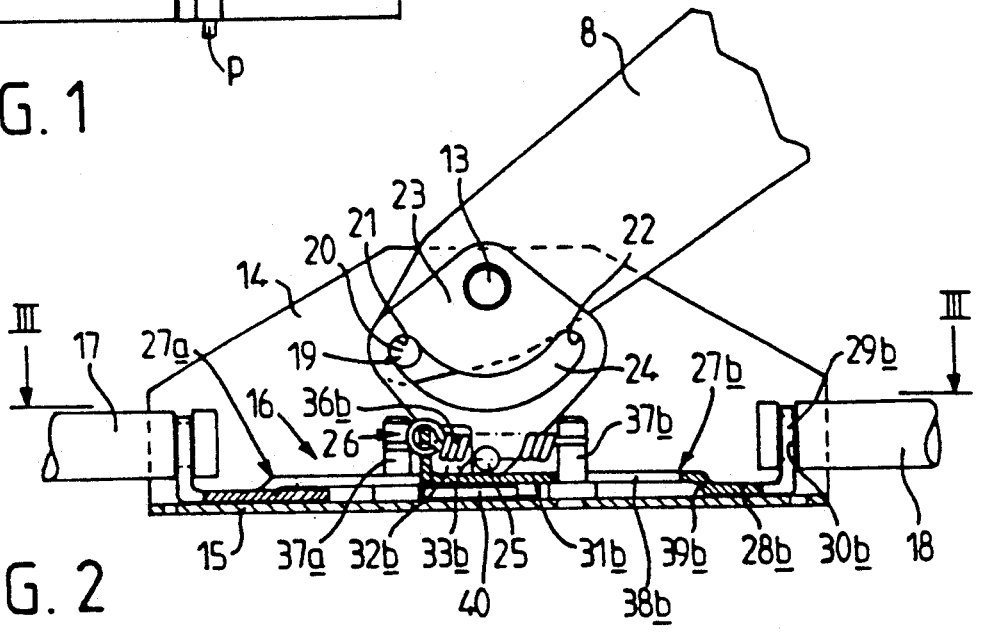
FIG. 2 is a cross-sectional view according to line II—II, FIG. 3, of a median housing according to the invention.

As can be seen in FIG. 2, lever 8 of the multipoint antipanic lock 6 is articulated about a transversal spindle 13. The housing 7 is formed of a U-shaped profile the concavity of which is oriented towards the side opposite to leaf 3 and the wings 14 of which are arranged to extend in a substantially vertical plane. The apices of these wings have been cut in an inclined direction providing the part of the wings 14 farthest away from leaf 3 a trapezoidal shape. The bottom of the housing, connecting the wings 14, is applied and secured against leaf 3.

The transversal spindle is borne by two wings 14, towards their edge farthest away from the bottom 15.

The housing 7 comprises a mechanism 16, actuated by the lever 8, capable of driving, in reverse direction, two rods 17, 18 located on both sides of the housing 7, in the extension of each other. These rods 17, 18 are intended to be in vertical position (see FIG. 1) when the lock is fitted onto leaf 3 of the door 1. Each rod 17, 18 is provided, at its end farthest away from the housing 7, with a bolt p, to bring about a locking at an upper and a lower point, respectively.

The actuating rod 8 comprises, at its end comprised in-between the wings 14, a unilateral thrust organ 19 formed by a pawl 20 orthogonal to the mean plane of lever 8 and to the plane of the wings 14.

The pawl 20 is capable of co-operating with one of two angularly spaced complementary thrust abutments 21, 22 provided for on a driving organ 23.

The thrust abutments 21, 22 are formed by the ends of an opening 24 having the shape of an arc of a circle centered about the spindle 13 of the lever.

The driving organ 23 is formed by a plate having a substantially rectangular shape, one apex of which is freely pivoting about the spindle 13 of the lever and the opposite apex of which is passed through by a pusher 25, formed by a pin, orthogonal to the mean plane of the organ 23 and projecting on both sides of this organ. This pusher 25 is capable of co-operating with an actuating device 26 for the rods 17, 18. The opening 24 has its ends 21, 22 located in the proximity of the apices of the other diagonal of the organ 23.

The driver 23 is located in the mean longitudinal plane of the housing 7 and its pusher is provided to co-operate, in the direction of rotation of the driver 23, with one of both identical components 27*a*, 27*b*, mounted to extend in opposite direction, for actuating the rods 17, 18.

Figure 7:
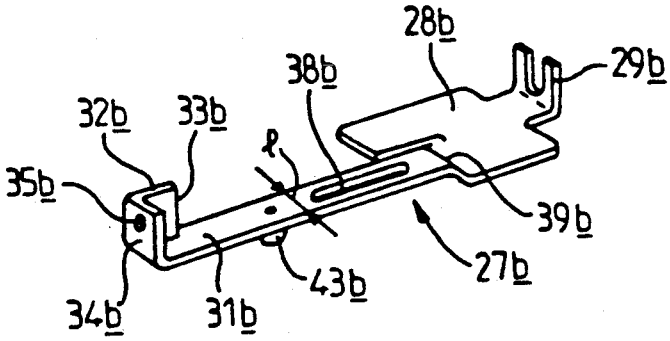
FIG. 7 is a perspective view of one of the sliding components of the mechanism of the housing.

Each component 27*a*, 27*b*, is slidingly mounted in the housing 7, against the bottom 15 of same. Component 27*b*, is described in detail below, viz. with reference to FIG. 7. The same description applies to component 27*a*, the similar parts of which are designated by the same reference numerals followed by the letter a instead of b.

Component 27*b*, comprises, at one end, a part 28*b*, shaped as a rectangular plate, having the same width as the inner width of the housing 7, so that it is guided by the inner faces of the wings 14. This plate 28*b*, comprises, on its edge oriented towards the rod 18, in its median area, an extension provided with a fork 29*b* located in a transversal plane orthogonal to the plane of the plate 28*b*. This fork 29*b* comprises a central notch open towards upside, capable of receiving, between its wings, the bottom of a groove 30*b* provided at the end of the rod 18. The legs of fork 29*b* are thus captured, in the sliding direction of rod 18, between the walls defining the groove 30*b*, which brings about a translating fit between component 27*b* and rod 18.

Plate 28*b* comprises, in the direction of the other component 27*a*, an extension 31*b* adjacent to an inner face of a wing 14 of the housing, the width l of which is slightly less than half of the inner width L (FIG. 3) of the housing.

Since both components 27*a*, 27*b* are oriented in opposite direction, each extension 31*a*, 31*b* (see FIG. 3) is adjacent to a distinct wing of the housing, so that there exists a free space between the edges in the proximity of the extension 31*a*, 31*b* for the driving organ 23. To attach the housing to a door, holes 14*a* are provided.

The extension 31*b* comprises, at its end farthest away from the fork 29*b* and the associated rod 18, a shoulder 32*b* the plane of which is orthogonal to the plate 28*b*, while being parallel to the longitudinal direction of the extension 31*b*, as well as to the wings 14. The pusher 25 of the driver 23 is capable of co-operating with the vertical edge 33*b* of shoulder 32*b*.

The extension 31*b* furthermore comprises a transversal wing 34*b* orthogonal to the shoulder 32*b* and to the mean plane of the extension 31*b*. This wing 34*b* comprises a hole 35*b* for fastening the end of a pull-off spring 36*b* the other end of which is fastened to a pin 37*b* integral with the bottom 15 of the housing. The pin 37*b*. perpendicular to the bottom 15, passes through an elongated opening 38*b* provided for in the extension 31*b*, so as to guide the movement in translation of component 27*b*.

Figure 5:
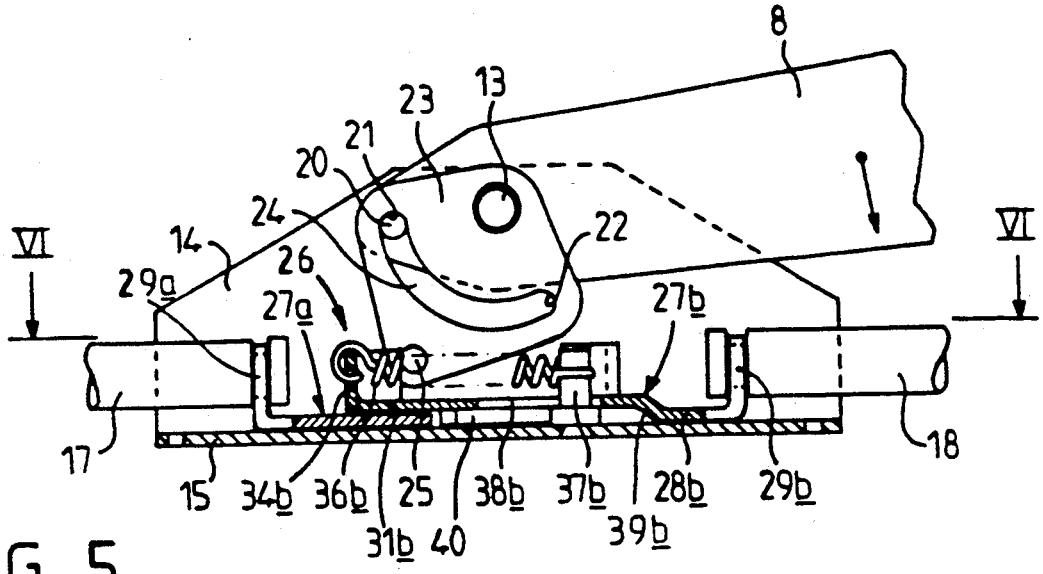
FIG. 5 is a cross-sectional view of the housing, according to line V—V, FIG. 6, but with the actuating lever lowered for the opening of the door.

As can be clearly seen in FIGS. 2 and 5, the extension 31*b* has its mean plane offset with respect to the mean plane of the plate 28*b*, so as to be apart from the bottom 15; a bent part 39*b* ensures the transition between the plate 28*b* and the extension 31*b*.

A rotary component 40 is arranged in the space comprised in-between the extensions 31*a*, 31*b* and the bottom 15. This component 40 is rotatingly mounted about a spindle 41 orthogonal to the bottom 15, mid-way between the wings 14 and plumb with the spindle 13.

Component 40 is formed by a kind of plate with a substantially rectangular periphery, with rounded apices, the sizes of which are such that said plate be able to rotate between the wings 14. Component 40 comprises, in the middle of each of its small sides, a cut 42*a*, 42*b* open towards outside, capable of receiving a pin 43*a*, 43*b* projecting under the associated extension 31*a*, 31*b*.

Component 40 is capable of transferring, while reversing same, the motion of a rod 17 to the other rod 18, or vice versa.

The components extensions 27*a*, 27*b* are symmetrical with respect to the center of rotation of component 40.

This being said, the operation of the housing 7 and the antipanic lock comprising such a housing is as follows.

The lever 8 in neutral position is inclined with respect to the bottom 15, so that the pawl 20 rests against the end 21 or the end 22 of opening 24.

In the neutral position shown in FIG. 2, the pawl 20 rests against the end 21 of opening 24, which corresponds to a type of door, e.g. a "left-hand" type door.

If this housing 7 is to be fitted onto a "right-hand" type door, it is enough to cause the lever 8 to pivot counterclockwise, about the spindle 13, as shown in FIGS. 2 and 5, so as to cause the pawl 20 to rest against the other end 22 of opening 24.

It appears thus that the adaptation of the housing of the lock for a "right-hand" type or a "left-hand" type door is immediate, by means of a simple operation requiring no specific tooling.

The operation of the lock, irrespective of the neutral position of lever 8, is the same and will be described for the position of lever 8 shown in FIG. 2.

By acting onto the actuating rod (see FIG. 1), the lever is caused to rotate clockwise, as shown in FIG. 2. The pawl 20 acts against the thrust 21 and causes the driver 23 to move clockwise about the spindle 13.

The pusher 25 acts against the edge 33*b* and moves component 27*b* towards the spring 36*b*. Rod 18 is drawn into the housing 7 and the bolt located at the lower end of rod 18 (see FIG. 1) is unlocked.

Figure 3:
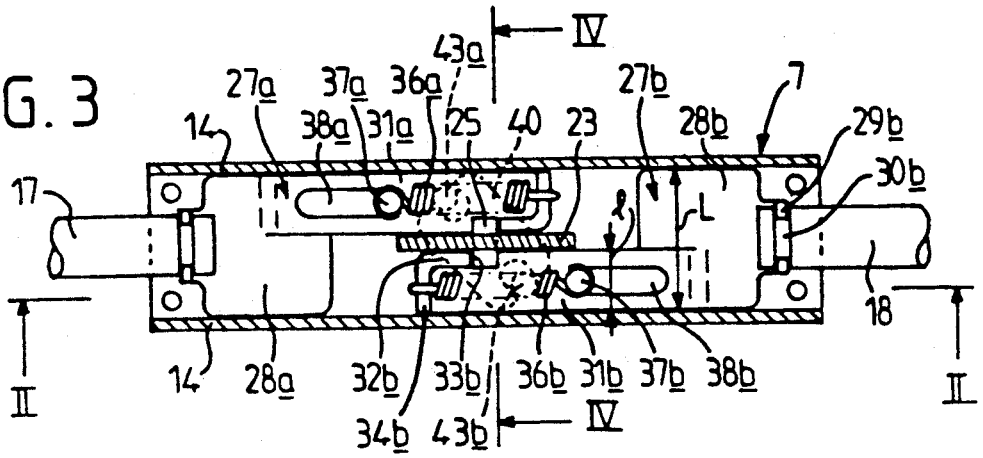
FIG. 3 is a view according to line III—III, FIG. 2.

Simultaneously, the rotary component 40 is rotatingly driven clockwise by pin 43*b* (as shown in FIG. 3) about the spindle 41.

Figure 6:
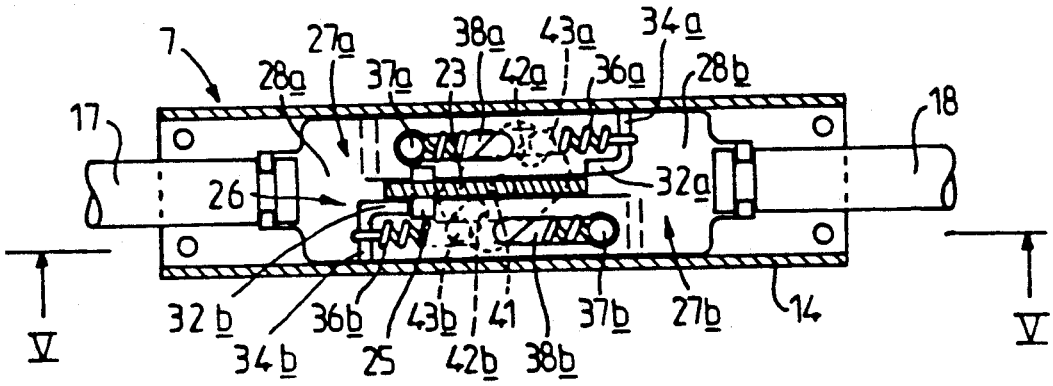
FIG. 6 is a view according to line VI—VI of FIG. 5.

The configuration of the housing, when lever 8 is pushed down, is shown in the FIGS. 5 and 6, respectively. The rotary component 40, actuated by the movement of component 27*b*, causes the translation, in opposite direction, of component 27*a* and thus the movement of rod 17 the upper bolt is also unlocked.

When lever 8 is released, the springs 36*a*, 36*b* pull off the components 27*a*, 27*b* into the closing position. The edge 33*b* acts onto the pusher 25 and pulls off the driver 23 as well as the lever 8 into the neutral position shown in FIG. 2.

Figure 8:
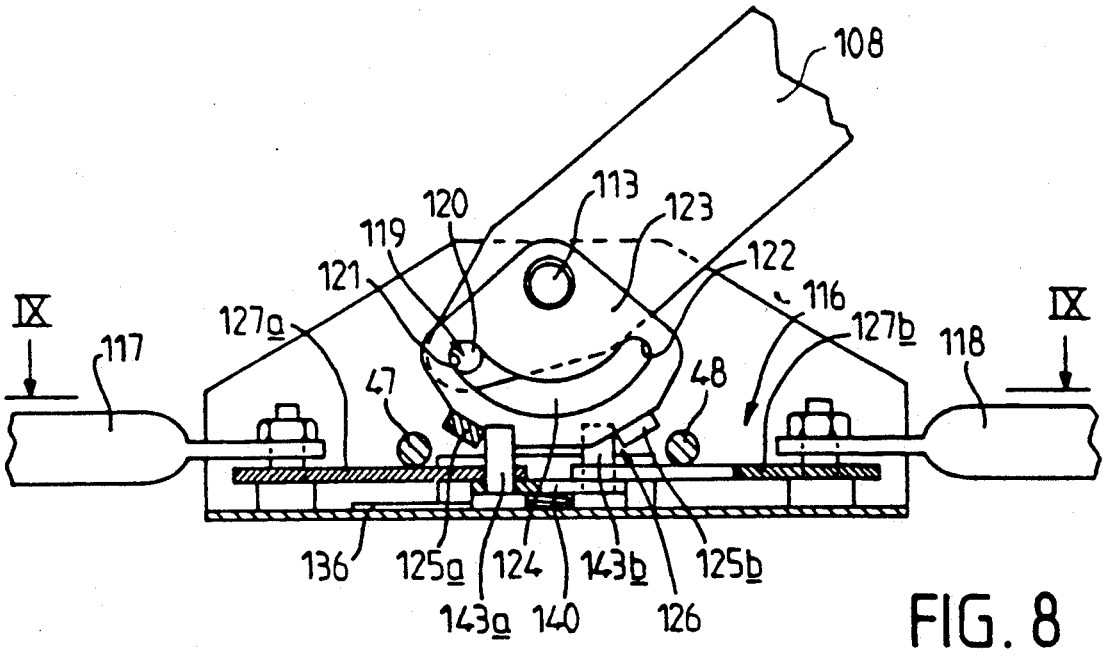
FIG. 8 shows, similarly to FIG. 2, a variant embodiment of the housing, cross-sectionally according to line VIII—VIII of FIG. 9.

With reference to FIGS. 8 through 10, one can see a variant embodiment of the housing for an antipanic lock according to the invention.

In this variant, the components which are identical or play analogous roles to the components already described with reference to the preceding Figures are designated by the same reference numerals increased by 100 and their description will not be repeated or will be repeated only briefly.

The rotary component 140, having an elongated rectangular shape, is connected, at each of its ends, by means of a joint, viz, formed by a pawl 143*a*, 143*b*, with the corresponding extension 131*a*, 131*b* of the sliding components 127*a*, 127*b*. This connection, which simplifies the embodiment, causes a rotary motion about the axis 141 of the ends of the extensions 131*a*, 131*b*.

In these circumstances, the sliding components 127*a*, 127*b* are mounted with a possibility of oscillating inside the housing 107. In particular, the parts 128*a*, 128*b* have rounded edges 44*a*, 44*b* in contact with the inner walls of the housing 107, to ensure a guiding of the oscillation.

These parts 128*a*, 128*b* are extended by areas of smaller width, so that there exists a backlash j between the edges of these areas and the inner surface of the housing.

One single torsional spring 136, comprising a winding into which is threaded the axis 141, is provided to pull off component 140 and the rods 117, 118 in neutral position. A leg 45 of this spring, curved at a right angle, rests against an inner wall of the housing 107; another leg 46 of the spring ensures the pulling-off of component 140 by resting against the pawl 143*b*.

Component 140 is thus pushed clockwise, as shown in FIG. 9, by this spring 136.

The pushing means 125 are advantageously formed by two feet 125*a*, 125*b* cut into plate 123, angularly spaced from each other and folded on both sides of the mean plane of the driving organ 123. These components 125*a*, 125*b* encircle the pawls 143*a*, 143*b* and are capable of acting against these pawls in order to ensure the driving of the mechanism by means of lever 108 and the organ 123.

Thus, according to this variant, the pusher 25 of FIGS. 2 through 7 is replaced by the feet 125*a*, 125*b*. The plates 127*a*, 127*b* have no longer elongated openings such as 38*a*, 38*b* (see FIG. 3).

One single torsional spring replaces two tension springs.

The pins 43*a*, 43*b*, of FIGS. 2 through 6, are replaced by the pawls 143*a*, 143*b*, while the pins 37*a*, 37*b*, integral with the bottom of the housing, in FIGS. 2 through 6, have disappeared in the variant of FIGS. 8 through 10.

Two spindles 47, 48, fixed between the inner walls of the housing 107, are provided for, parallel to spindle 113, in the proximity of the bottom of the housing, so as to retain the plates 127*a*, 127*b*.

The operation of this variant is similar to the one described with reference to FIGS. 2 through 7 and it does not seem to be useful to describe same once again.

What is claimed is:

1. An antipanic locking device for a door of either the left-hand or right-hand opening type comprising a housing mountable on the door, an actuating lever being pivotally mounted on spindle means carried by said housing and movable to actuate said locking deice to thereby drive in opposite directions two rods; one each located on an opposite side of said housing from the other rod, each rod having an end remote from said housing with each end having a bolt, said actuating lever having a thrust member adjacent one end thereof, a thrust means having a portion rotatably carried on said housing, said thrust means including a pair of abutment means, one of said abutment means being engageable by said thrust member upon actuation of said lever in one direction about said spindle means and the other of said abutment means being engageable by said thrust member upon actuation of said lever in a direction opposite to said one direction, said locking device including an actuation mechanism for moving said rods from a projecting to a withdrawn position with said actuation mechanism being driven by movement of said thrust means, wherein said thrust member is a pawl carried by said lever and said thrust means is a plate lieing in a plane extending substantially orthogonal to said spindle means, said plate having an arcuate opening and said pair of abutment means comprise the opposite ends of said arcuate opening, said opening having a radius of curvature centered on said spindle means.

2. The invention as claimed in claim 1 wherein said plate has a substantially rectangular shape and is pivotable about said spindle means, said plate cooperating with said actuation mechanism and said ends of said arcuate opening lie adjacent opposite corners of said plate.

3. The invention as claimed in claim 2 wherein said housing has a longitudinal axis and said thrust means extends parallel to said longitudinal axis and includes pushing means which extends on opposite sides of said plane, said actuation mechanism including means cooperating with said pushing means to move said rods upon movement of said thrust means.

4. The invention as claimed in claim 3 wherein said means cooperating with said pushing means are a pair of plate members slidingly disposed in said housing and having the same width as said housing and each being connected to an end of a said rod at an end thereof having a width less than half the width of said housing with thrust means being disposed between said ends.

5. The invention as claimed in claim 4 wherein said housing has a bottom wall and said actuation mechanism includes a rotating member mounted on a pin carried by said bottom wall, each of said plate member having stud means engageable by said rotating member.

6. The invention as claimed in claim 5 wherein said rotating member has a substantially rectangular shape and opposite sides of said rotating member are provided with a recess engaging said stud means.

7. The invention as claimed in claim 6 wherein said plate members each have a shoulder adjacent said respective ends thereof for engagement with said pushing means.

8. The invention as claimed in claim 7 wherein each shoulder has a wing portion and said bottom wall has spaced pin members with spring means attached between each wing portion and a respective pin member.

9. The invention as claimed in claim 8 wherein said ends of said plate members are each formed with an elongated slot therein with said pin member extending through a said respective slot.

10. The invention as claimed in claim 5 wherein spring means are provided to rotate said rotating member to a neutral position, said spring means acting between one of said stud means and one of said plate members.

11. The invention as claimed in claim 5 wherein said pushing means comprises two angularly spaced feet located on opposite sides of said thrust means.

12. An antipanic locking device for a door having an interior and an exterior side and being of either the left-hand or right-hand opening type comprising a housing mountable on the interior side of the door, an actuating lever being pivotally mounted on spindle means carried by said housing so as to extend parallel to the plane of the door and movable to actuate said locking device to thereby drive in opposite directions two rods; one each located on an opposite side of said housing from the other rod, each rod having an axis extending orthogonal to said spindle means and an end remote from said housing with each end having a bolt, said actuating lever having a thrust member adjacent one end thereof and projecting transversely therefrom, a thrust means having a portion rotatably carried on said housing, said thrust means including a pair of abutment means, one of said abutment means being engageable by said thrust member upon actuation of said lever in one direction about said spindle means corresponding to the door opening to the right and the other of said abutment means being engageable by said thrust member upon actuation of said lever in a direction opposite to said one direction corresponding to the door opening to the left, said locking device including an actuation mechanism for moving said rods from a projecting to a withdrawn position with said actuation mechanism being driven by movement of said thrust means, said actuating lever being shiftable from engagement with one of said abutment means to the other abutment means without disassembly of said housing.

* * * * *